US010989373B1

(12) United States Patent
Gall

(10) Patent No.: US 10,989,373 B1
(45) Date of Patent: Apr. 27, 2021

(54) FESTIVE DIWALI LIGHT APPARATUS

(71) Applicant: Laura Gall, Langley (CA)

(72) Inventor: Laura Gall, Langley (CA)

( * ) Notice: Subject to any disclaimer, the term of this patent is extended or adjusted under 35 U.S.C. 154(b) by 0 days.

(21) Appl. No.: 16/802,288

(22) Filed: Feb. 26, 2020

(51) Int. Cl.

| | |
|---|---|
| ***F21S 4/10*** | (2016.01) |
| ***F21V 3/02*** | (2006.01) |
| ***F21L 4/08*** | (2006.01) |
| ***F21V 17/06*** | (2006.01) |
| ***F21V 17/16*** | (2006.01) |
| ***F21W 121/00*** | (2006.01) |

(52) U.S. Cl.
CPC . *F21S 4/10* (2016.01); *F21L 4/08* (2013.01); *F21V 3/02* (2013.01); *F21V 17/06* (2013.01); *F21V 17/16* (2013.01); *F21W 2121/00* (2013.01)

(58) Field of Classification Search
CPC ..... F21S 4/10; F21S 4/00–20; F21V 3/02; F21W 2121/00; F21Y 2115/10
USPC .... 362/249, 16, 249.14, 653, 654, 640, 806, 362/457
See application file for complete search history.

(56) References Cited

U.S. PATENT DOCUMENTS

| | | | | |
|---|---|---|---|---|
| 3,596,859 | A * | 8/1971 | MacDonald | F21S 4/10 248/214 |
| 5,707,136 | A * | 1/1998 | Byers | F21V 3/02 362/145 |
| D429,351 | S | 8/2000 | Grether | |
| 6,690,120 | B2 | 2/2004 | Oskorep | |
| 7,175,302 | B2 | 2/2007 | Kazar | |
| 7,815,328 | B2 * | 10/2010 | Van Dyn Hoven | H01K 1/32 362/96 |
| 2004/0174708 | A1 * | 9/2004 | Wu | F21V 7/05 362/296.05 |
| 2005/0111221 | A1 | 5/2005 | Van Dyn Hoven | |
| 2005/0185400 | A1 | 8/2005 | Hsu | |
| 2009/0190361 | A1 * | 7/2009 | Chung | F21V 17/02 362/341 |
| 2011/0050112 | A1 | 3/2011 | Janning | |
| 2018/0045389 | A1 | 2/2018 | Tu | |
| 2019/0338902 | A1 * | 11/2019 | Zinsky | F21S 6/004 |

FOREIGN PATENT DOCUMENTS

| | | |
|---|---|---|
| EP | 3324101 | 5/2017 |

* cited by examiner

*Primary Examiner* — Andrew J Coughlin
*Assistant Examiner* — Jessica M Apenteng

(57) ABSTRACT

A festive Diwali light apparatus for celebrating Diwali includes a plurality of lights with each light comprising a light housing and a flame light bulb coupled to the light housing. The flame light bulb is shaped like a Diya oil lamp flame. Each of a plurality of decorative attachments has a Rangoli-shaped decorative portion and an attachment portion. The attachment portion is selectively engageable with the light housing of the plurality of lights. A cord is coupled to the plurality of lights. The cord is coupled to the light housing of each light and is in operational communication with the respective flame light bulb. A plug is coupled to the cord.

2 Claims, 4 Drawing Sheets

FESTIVE DIWALI LIGHT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to decorative light devices and more particularly pertains to a new decorative light device for celebrating Diwali.

(2) Description of Related Art Including Information Disclosed Under 37 CFR 1.97 and 1.98

The prior art relates to decorative light devices for celebrating and commemorating holidays. Existing devices typically employ colored light bulbs with certain color patterns for particular holidays, although they are typically not representative of Diwali. Existing light devices also fail to incorporate decorative attachment pieces to further embellish the design, and in particular do not offer Rangoli shapes typical of Diwali.

BRIEF SUMMARY OF THE INVENTION

An embodiment of the disclosure meets the needs presented above by generally comprising a plurality of lights with each light comprising a light housing and a flame light bulb coupled to the light housing. The flame light bulb is shaped like a Diya oil lamp flame. Each of a plurality of decorative attachments has a Rangoli-shaped decorative portion and an attachment portion. The attachment portion is selectively engageable with the light housing of the plurality of lights. A cord is coupled to the plurality of lights. The cord is coupled to the light housing of each light and is in operational communication with the respective flame light bulb. A plug is coupled to the cord.

An alternative embodiment of the disclosure comprises a light housing having a cylindrical upper portion and a spiked lower portion. A flame light bulb is coupled to the light housing and is shaped like a Diya oil lamp flame. A decorative attachment is coupled to the light housing. The decorative attachment is coupled to the cylindrical upper portion and the decorative attachment is Rangoli-shaped. A solar panel is coupled to a top side of the decorative attachment. A battery is coupled within the light housing and is in operational communication with the solar panel and the flame light bulb.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
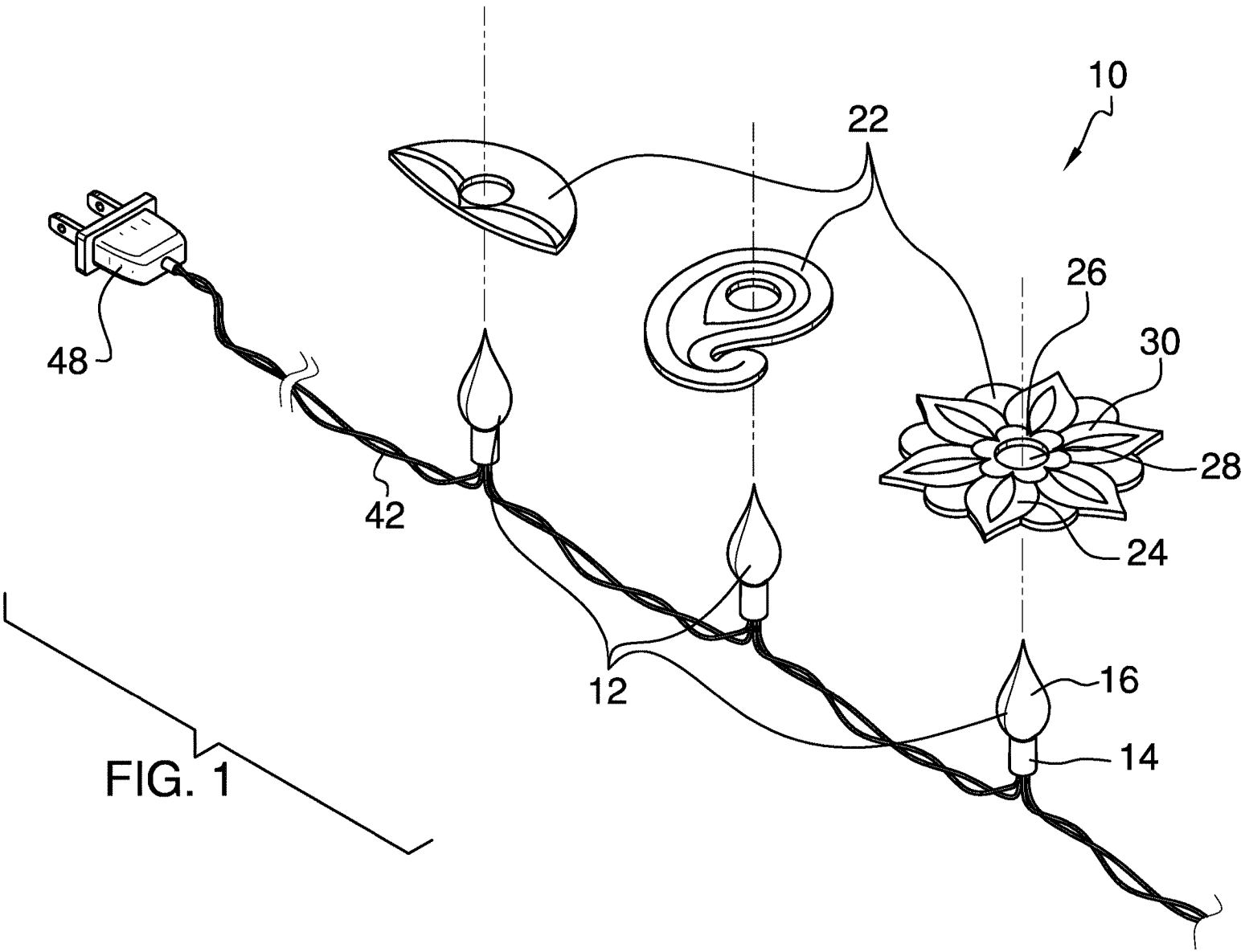
FIG. 1 is an isometric view of a festive Diwali light apparatus according to an embodiment of the disclosure.
Figure 2:
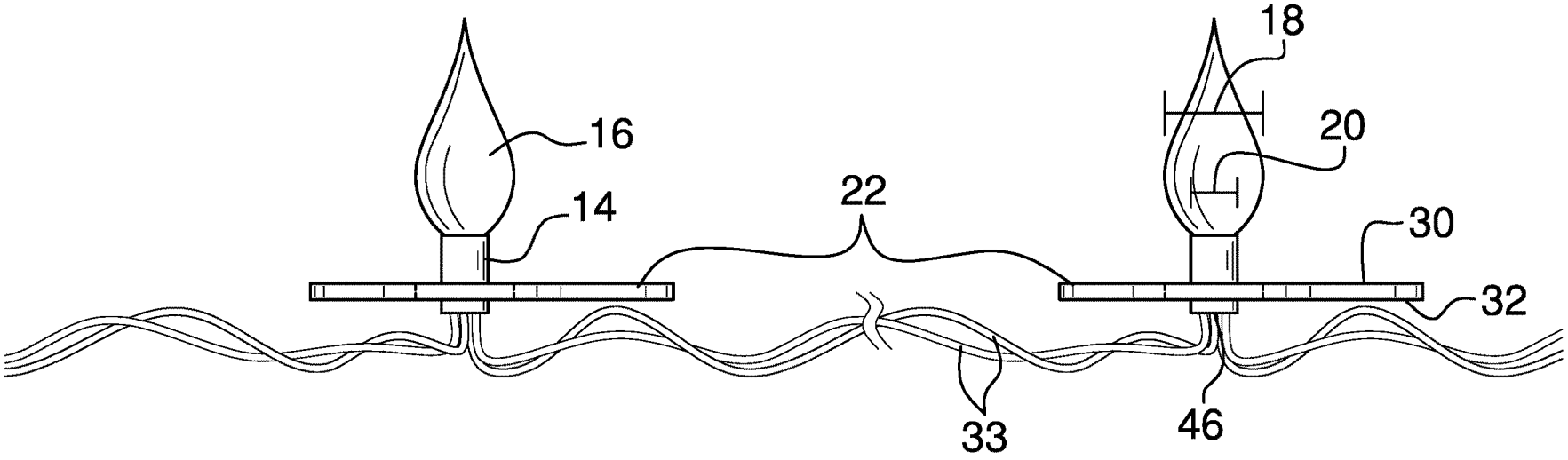
FIG. 2 is a front elevation view of an embodiment of the disclosure.
Figure 3:
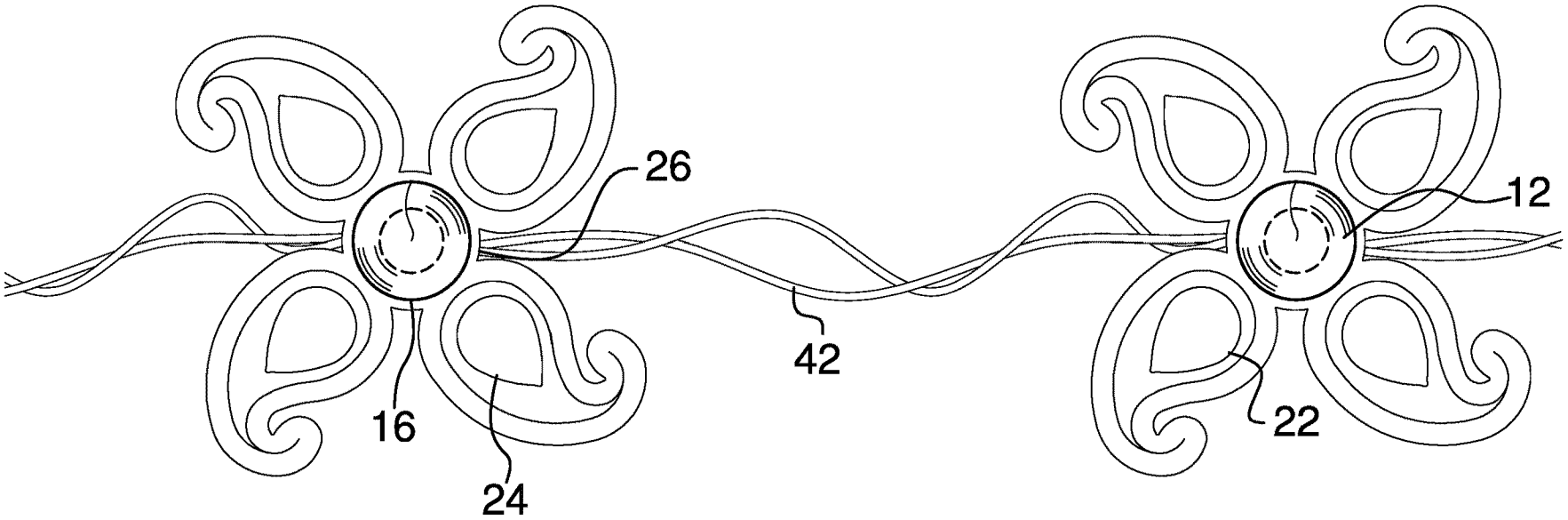
FIG. 3 is a top plan view of an embodiment of the disclosure.

With reference now to the drawings, and in particular to FIGS. 1 through 5 thereof, a new decorative light device embodying the principles and concepts of an embodiment of the disclosure and generally designated by the reference numeral 10 will be described.

As best illustrated in FIGS. 1 through 5, the festive Diwali light apparatus 10 generally comprises a plurality of lights 12. Each light 12 comprises a cylindrical light housing 14 and a flame light bulb 16 coupled to the light housing 14. The flame light bulb 16 is shaped like a Diya oil lamp flame. The flame light bulb 16 may be selectively removable from the light housing 14 for replacement. A bulb width 18 of each flame light bulb may be greater than a housing width 20 of the light housing. The flame light bulb 16 of the plurality of lights may produce different colors including, but not limited to, orange, yellow, red, purple, and blue.

Each of a plurality of decorative attachments 22 has a Rangoli-shaped decorative portion 24 and an attachment portion 26. The decorative portion 24 may be representative of Rangoli shapes and other relevant objects such as, but not limited to, flowers, butterflies, corn, food, the sun, and the moon. The attachment portion 26 is selectively engageable with the light housing 14 of the plurality of lights. In one embodiment best shown in FIG. 1, the attachment portion 26 may be an attachment aperture 28 extending from a top side 30 through a bottom side 32 of the decorative attachment.

Figure 4:
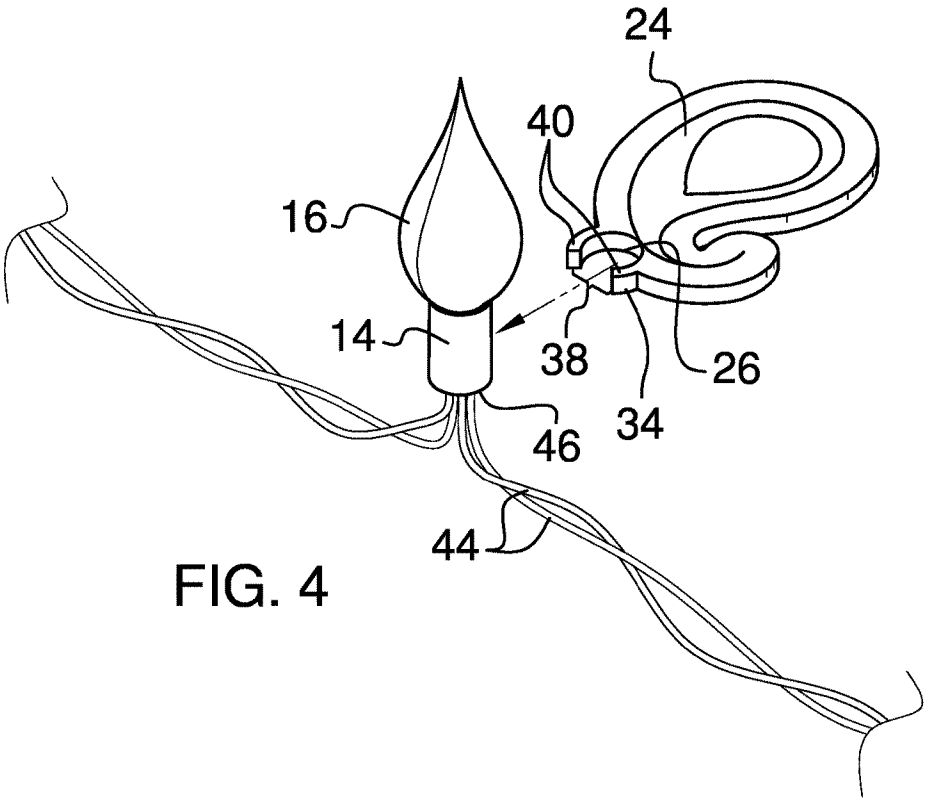
FIG. 4 is an isometric view of an embodiment of the disclosure.

In another embodiment best shown in FIG. 4, the attachment portion 26 may be a circular clip 34 extending from the decorative portion 24. The circular clip 34 defines an open receiving portion 38 dimensioned to elastically receive and secure the light housing 14. A pair of distal ends 40 of the clip 33 may each be angled outward to force the receiving portion 38 to expand simply by applying force to the light housing 14. Each decorative attachment 22 may be planar and lies in a plane perpendicular to a central axis of the respective light housing 14 when engaged.

A cord 42 is coupled to the plurality of lights 12. The cord 42 is coupled to the light housing 14 of each light and is in operational communication with the respective flame light bulb 16. The cord 42 may comprise a pair of wires 44 each entering and exiting a housing bottom end 46 of the light housing 14. The cord 42 may be any color other than green. A plug 48 is coupled to the cord 42 to connect the apparatus 10 to a power source.

Figure 5:
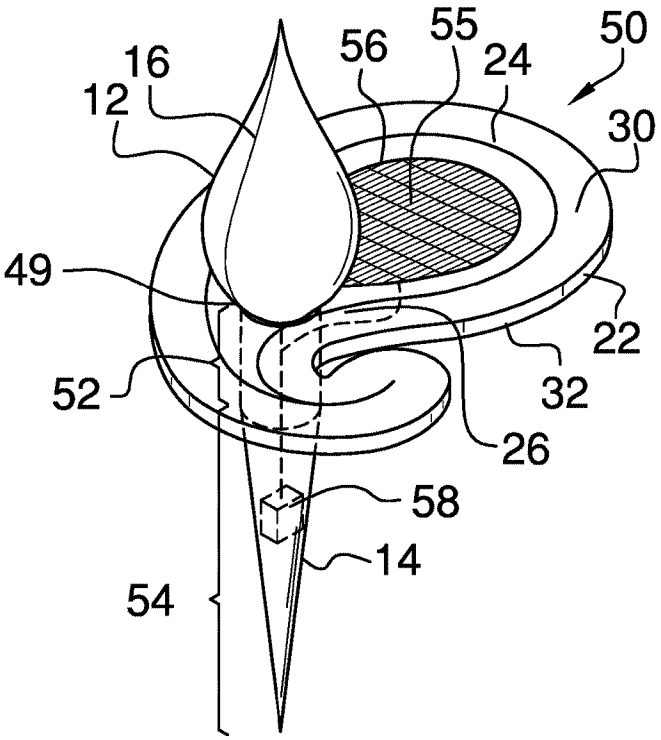
FIG. 5 is an isometric view of an embodiment of the disclosure.

In an alternative embodiment of the invention 50 shown in FIG. 5, the light housing 14 has a cylindrical upper portion 52 and a spiked lower portion 54. The spiked lower portion 54 is configured to be inserted into the ground, such as in a front lawn with the upper portion 52 remaining exposed. The Diya oil lamp flame-shaped flame light bulb 16 is coupled to the light housing 14.

The decorative attachment 22 is coupled to the light housing 14. The Rangoli-shaped decorative attachment 22 may be coupled to the cylindrical upper portion 52 adjacent a housing top end 49. The decorative attachment 22 may be planar and lies in a plane perpendicular to a central axis of the light housing 14. A solar panel 55 is coupled to the decorative attachment 22. The solar panel 55 may be coupled to the top side 30 of the decorative attachment and may conform to an inner design line 56 of the Rangoli-shaped decorative attachment 22 to appear less conspicuous. A battery 58 is coupled within the light housing 14 and is in operational communication with the solar panel 55 and the flame light bulb 16.

In use, the apparatus 10 is placed as decoration on a building exterior or interior. The plurality of decorative attachments 22 are engaged as desired with the light housings 14 of the plurality of lights and the plug 48 is connected to a power source.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A festive Diwali light apparatus comprising:

a light housing having a cylindrical upper portion and a spiked lower portion;

a flame light bulb coupled to the light housing;

a decorative attachment coupled to the light housing, the decorative attachment being coupled to the cylindrical upper portion;

a solar panel coupled to the decorative attachment, the solar panel being coupled to a top side of the decorative attachment, the solar panel conforming to an inner design line of the decorative attachment; and a battery coupled within the light housing, the battery being in operational communication with the solar panel and the flame light bulb.

2. The festive Diwali light apparatus of claim 1 further comprising the decorative attachment being planar and lying in a plane perpendicular to a central axis of the light housing.

* * * * *